US008327814B2

(12) United States Patent
Orban et al.

(10) Patent No.: US 8,327,814 B2
(45) Date of Patent: Dec. 11, 2012

(54) ENGINE ROCKER ARM

(75) Inventors: Hatem Zakaria Orban, Auburn Hills, MI (US); Robert S. McAlpine, Lake Orion, MI (US); Akram R. Zahdeh, Rochester Hills, MI (US)

(73) Assignee: GM Global Technology Operations LLC

( * ) Notice: Subject to any disclaimer, the term of this patent is extended or adjusted under 35 U.S.C. 154(b) by 530 days.

(21) Appl. No.: 12/565,160

(22) Filed: Sep. 23, 2009

(65) Prior Publication Data

US 2011/0067660 A1 Mar. 24, 2011

(51) Int. Cl.
*F01L 1/34* (2006.01)

(52) U.S. Cl. ..... 123/90.16; 123/90.39

(58) Field of Classification Search ..... 123/90.16, 123/90.39; 74/559, 569
See application file for complete search history.

(56) References Cited

U.S. PATENT DOCUMENTS 5,251,585 A * 10/1993 Graber ..... 123/90.39
5,720,245 A * 2/1998 Calka ..... 123/90.41

* cited by examiner

*Primary Examiner* — Zelalem Eshete
(74) *Attorney, Agent, or Firm* — Harness, Dickey & Pierce, P.L.C.

(57) ABSTRACT

A rocker arm may include a valve engagement region, a lift mechanism engagement region, a pivot region, and a body portion. The valve engagement region may be located at a first longitudinal end of the rocker arm and on a first side of the rocker arm. The lift mechanism engagement region may be located at a second longitudinal end of the rocker arm. The pivot region may be located between the valve engagement region and the lift mechanism engagement region and may define a rotational axis for the rocker arm. The body portion may extend longitudinally between and couple the valve engagement region, the pivot region and the lift mechanism engagement region to one another. The body portion may define first and second ribs on a second side of the rocker arm that extend longitudinally between the valve engagement region and the lift mechanism engagement region.

16 Claims, 4 Drawing Sheets

FIG 4
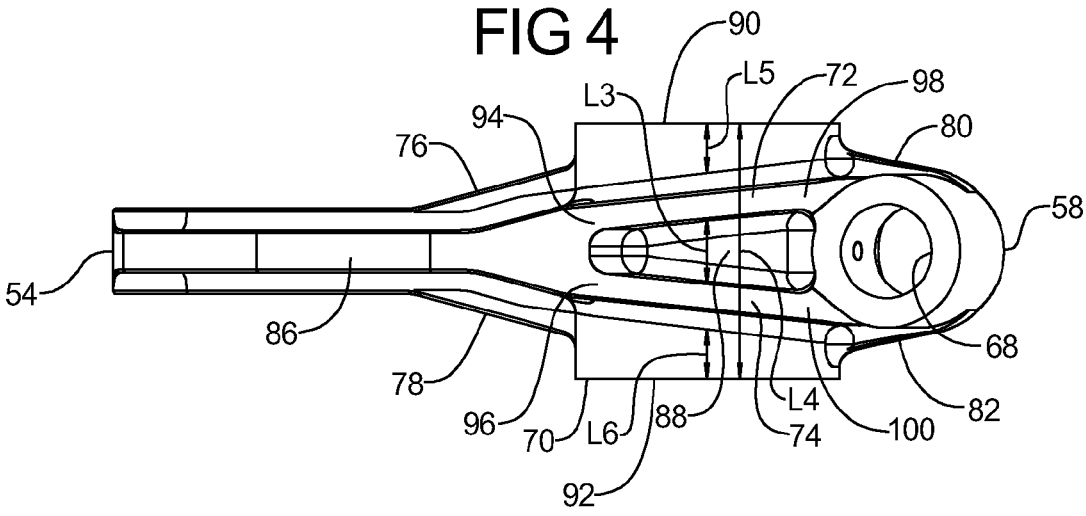
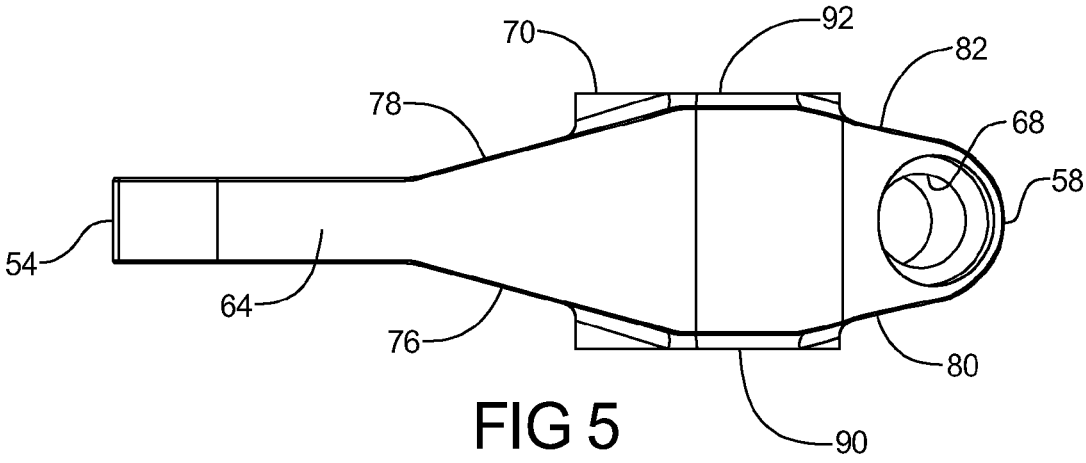
FIG 5

ENGINE ROCKER ARM

FIELD

The present disclosure relates to engine rocker arms.

BACKGROUND

This section provides background information related to the present disclosure which is not necessarily prior art.

Internal combustion engines may combust a mixture of air and fuel in cylinders and thereby produce drive torque. Air and fuel flow into and out of the cylinders may be controlled by a valvetrain. The valvetrain may include a camshaft that actuates intake and exhaust valves and thereby controls the timing and amount of air and fuel entering the cylinders and exhaust gases leaving the cylinders. Overhead valve (OHV) valvetrains may include lifters, pushrods, and rocker arms coupled to the intake and exhaust valves. The camshaft may actuate the intake and exhaust valves via the lifters, push rods, and rocker arms.

SUMMARY

A rocker arm may include a valve engagement region, a lift mechanism engagement region, a pivot region, and a body portion. The valve engagement region may be located at a first longitudinal end of the rocker arm and on a first side of the rocker arm. The lift mechanism engagement region may be located at a second longitudinal end of the rocker arm opposite the first longitudinal end. The pivot region may be located between the valve engagement region and the lift mechanism engagement region and may define a rotational axis for the rocker arm. The body portion may extend longitudinally between the valve engagement region, the pivot region and the lift mechanism engagement region and may couple the valve engagement region, the lift mechanism engagement region and the pivot region to one another. The body portion may define first and second ribs on a second side of the rocker arm opposite the first side. The first and second ribs may extend longitudinally between the valve engagement region and the lift mechanism engagement region.

In another arrangement, a rocker arm may include a valve engagement region, a lift mechanism engagement region, a pivot region, and a body portion. The valve engagement region may be located at a first end of the rocker arm and may include an engagement surface having a non-constant radius of curvature adapted to engage an engine valve. Tangent lines may be defined at points of contact between the valve and the engagement surface. The tangent lines may be generally perpendicular to a longitudinal axis of the valve during displacement of the valve by the rocker arm. The lift mechanism engagement region may be located at a second end of the rocker arm opposite the first end. The pivot region may be located between the valve engagement region and the lift mechanism engagement region and may define a rotational axis for the rocker arm. The body portion may extend longitudinally between the valve engagement region, the pivot region and the lift mechanism engagement region and may couple the valve engagement region, the lift engagement region and the pivot region to one another.

An engine assembly may include an engine structure defining a combustion chamber and a port, a valve supported by the engine structure, and a rocker arm rotationally supported by the engine structure. The valve may be displaceable along a longitudinal valve axis from a closed position to an open position to selectively provide communication between the port and the combustion chamber. The rocker arm may include a valve engagement region located at a first end of the rocker arm and having an engagement surface with a non-constant radius of curvature engaged with the valve and defining tangent lines at points of contact with the valve that are generally perpendicular to the longitudinal valve axis during displacement of the valve by the rocker arm.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

FIG. 4 is a second plan view of the rocker arm of FIG. 2;

FIG. 5 is a third plan view of the rocker arm of FIG. 2; and

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
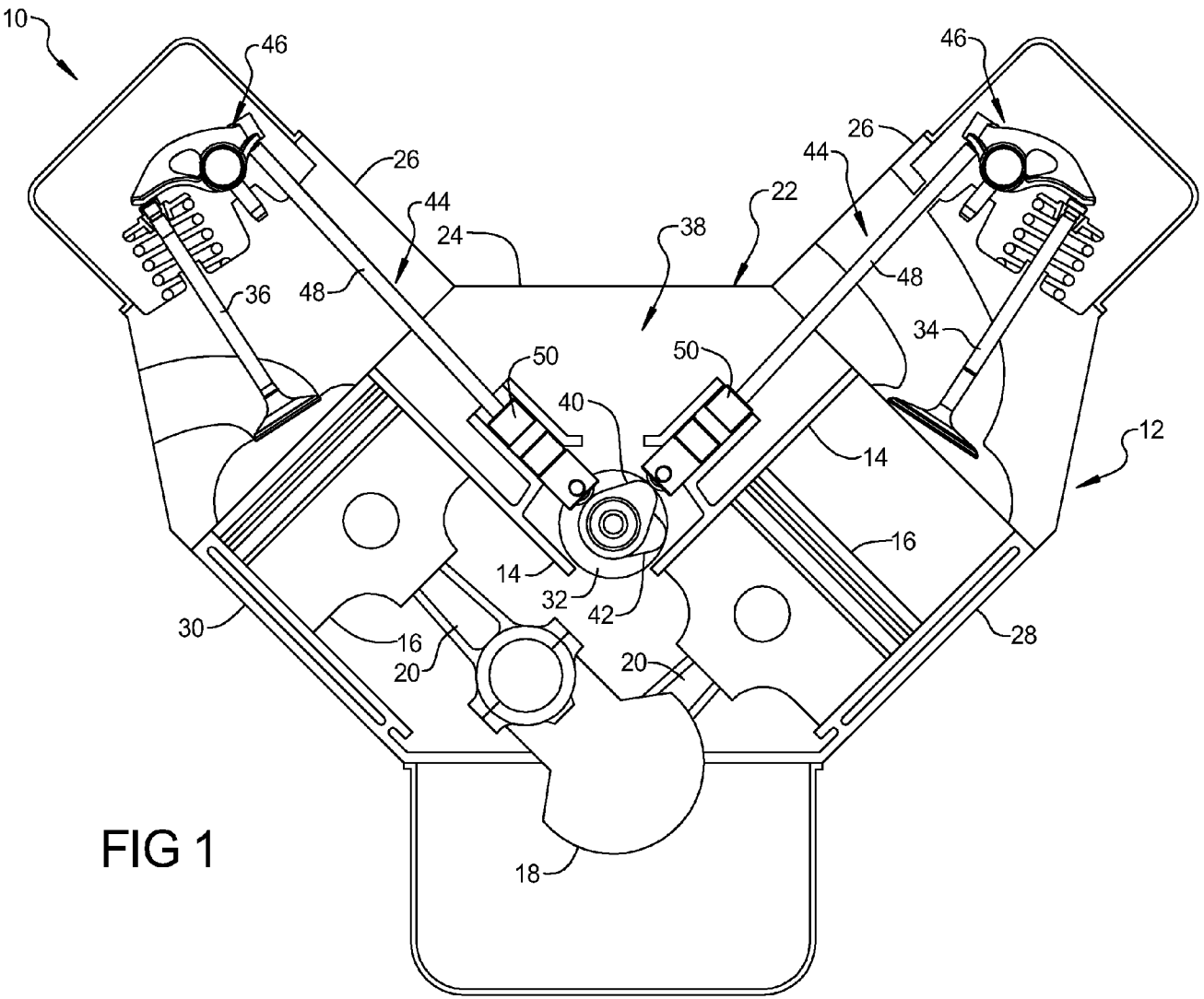
FIG. 1 is schematic illustration of an engine assembly according to the present disclosure.
Figure 2:
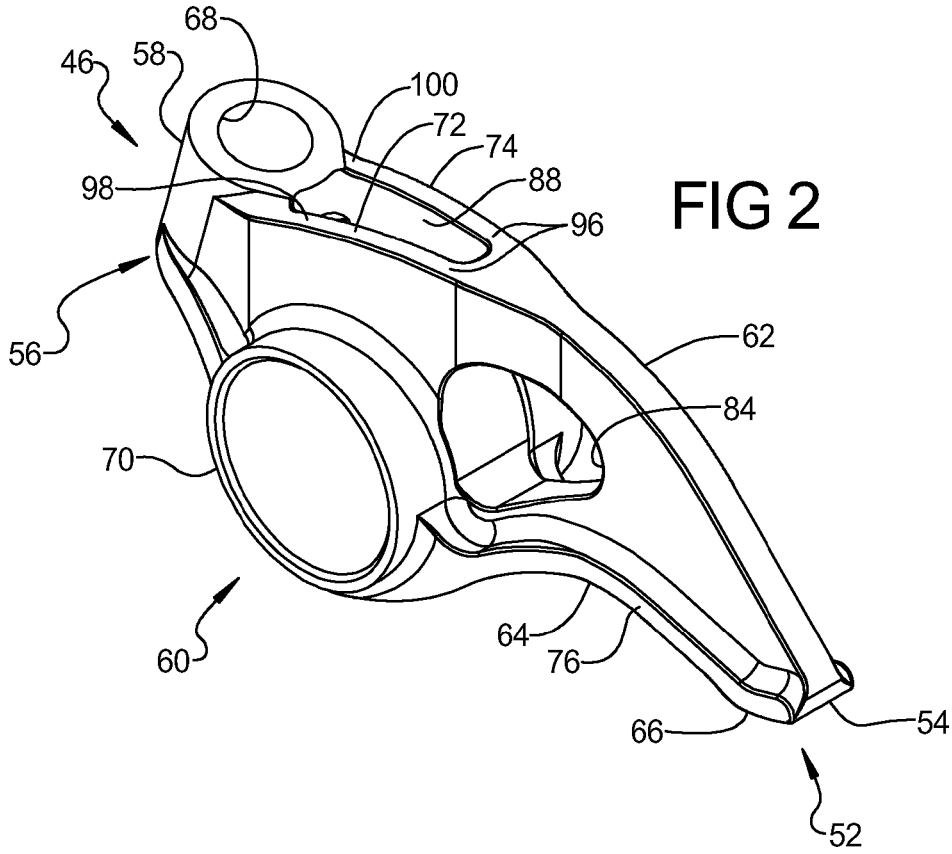
FIG. 2 is a perspective view of the rocker arm shown in FIG. 1.
Figure 3:
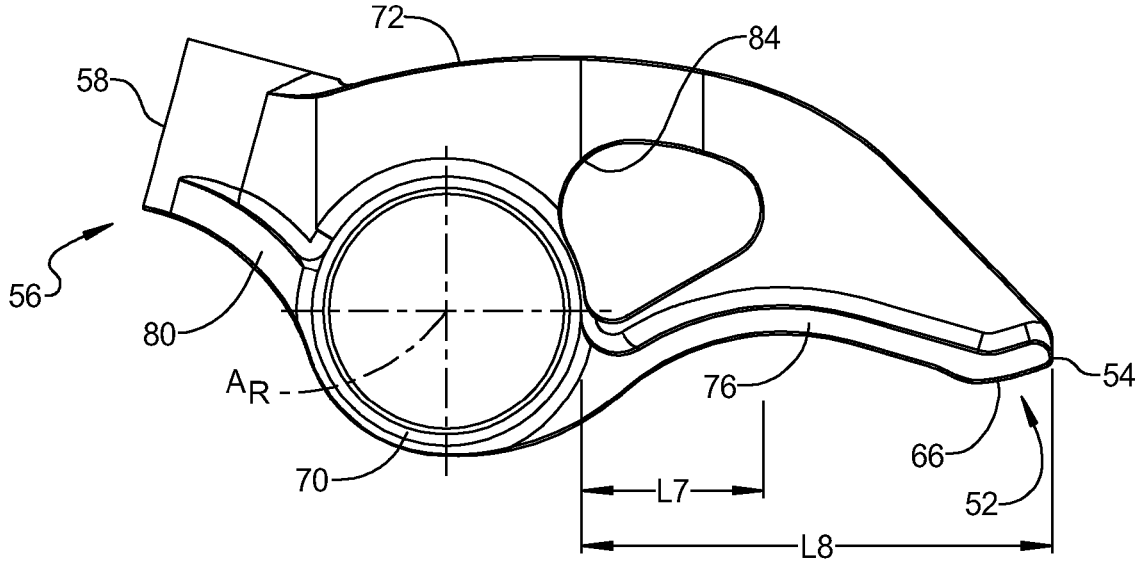
FIG. 3 is a first plan view of the rocker arm of FIG. 2.

With reference to FIG. 1, an engine assembly 10 is illustrated. The engine assembly 10 may include a cam-in-block design having a V-configuration. The engine assembly 10 may include an engine structure 12 defining cylinders 14, pistons 16 disposed within the cylinders 14, a crankshaft 18, connecting rods 20 coupling the pistons 16 to the crankshaft 18, and a valvetrain assembly 22. The engine structure 12 may include an engine block 24 and cylinder heads 26. The engine block 24 may define a V-configuration having first and second banks 28, 30 of cylinders 14 disposed at an angle relative to one another. However, it is understood that the present disclosure is not limited to engines having a V-configuration.

The valvetrain assembly 22 may include a camshaft 32, intake and exhaust valves 34, 36, and a valve actuation assembly 38. The camshaft 32 may include intake and exhaust lobes 40, 42. The valve actuation assembly 38 may be engaged with the intake and exhaust lobes 40, 42 and the intake and exhaust valves 34, 36 to selectively open the intake and exhaust valves 34, 36. The valve actuation assembly 38 may include valve lift mechanisms 44 and rocker arms 46. The valve lift mechanism 44 may include a pushrod 48 engaged with the rocker arms 46 and a lifter 50 engaged with the camshaft 32.

Each of the rocker arms 46 may be similar to one another. Therefore, for simplicity, a single rocker arm 46 will be described with respect to the intake valve 34 with the understanding that the description applies equally to the remainder of the rocker arms 46. With additional reference to FIGS. 2-5, the rocker arm 46 may include a valve engagement region 52 at a first longitudinal end 54, a lift mechanism engagement region 56 at a second longitudinal end 58 opposite the first end 54, a pivot region 60 located between the valve engagement region 52 and the lift mechanism engagement region 56, and a body portion 62 extending longitudinally between the valve engagement region 52 and the lift mechanism engagement region 56.

Figure 6:
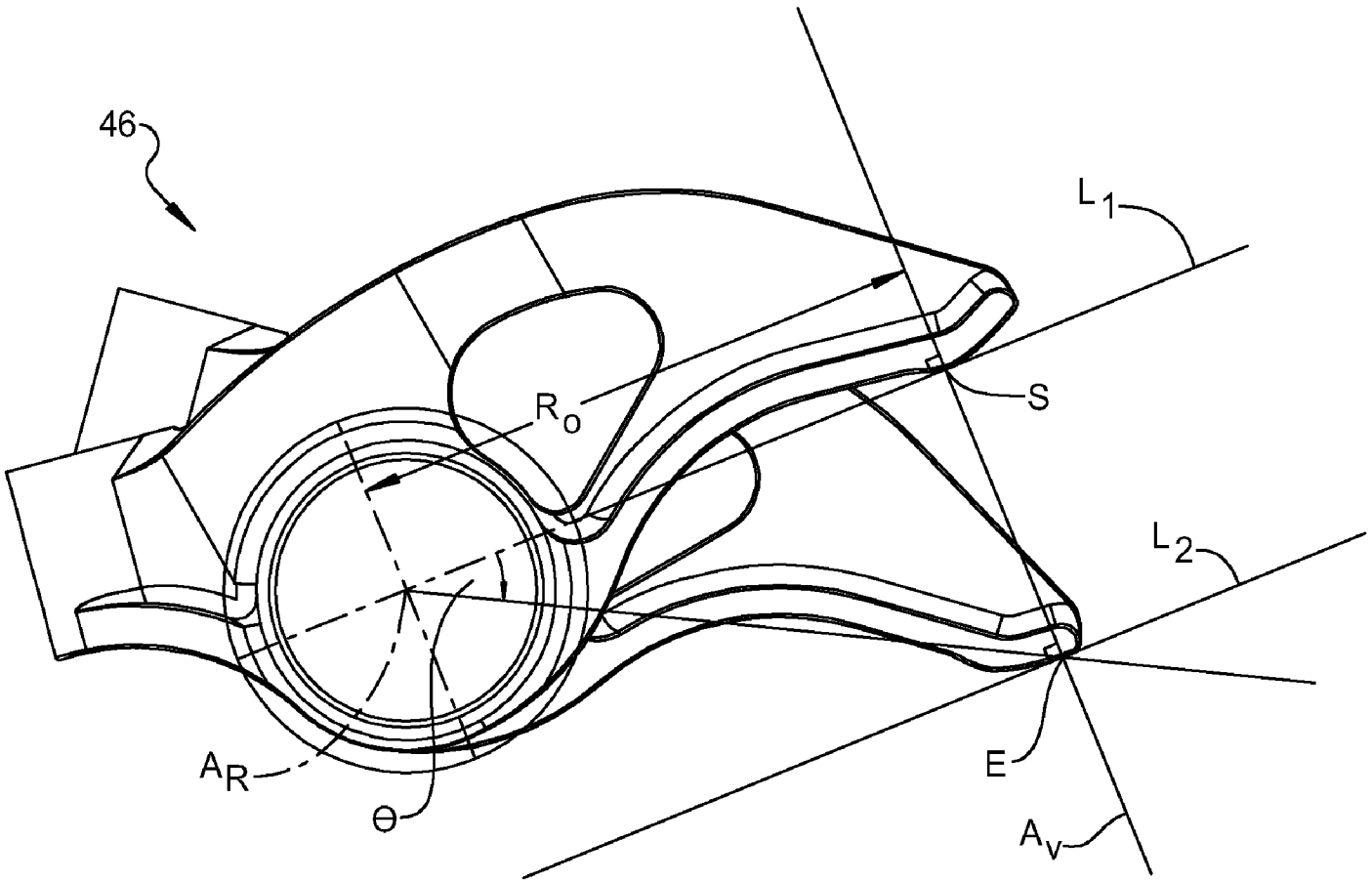
FIG. 6 is a schematic illustration of the rocker arm of FIG. 2 in first and second positions illustrating engagement between the rocker arm and a corresponding valve.

The valve engagement region 52 may be located on a first side 64 of the rocker arm 46 and may define a surface 66 engaged with the intake valve 34. With additional reference to FIG. 6, the surface 66 may define a starting point (S) where opening displacement of the intake valve 34 begins and an end point (E) where opening displacement of the intake valve 34 terminates (i.e., valve fully open). A line (L1) tangent to the starting point (S) on the surface 66 may be perpendicular to the linear axis ($A_V$) that the intake valve 34 is displaced along. The line (L1) may additionally intersect and be perpendicular to the rotational axis ($A_R$) of the rocker arm 46. The rocker arm 46 may be rotated an angle (θ) along the rotational axis ($A_R$) from a first position where the starting point (S) is engaged with the intake valve 34 to a second position where the ending point (E) is engaged with the intake valve 34.

The surface 66 may have a non-constant radius of curvature from the starting point (S) to the ending point (E). More specifically, the radius of curvature of the surface 66 may continuously increase from the starting point (S) to the ending point (E). As indicated above, the tangent line (L1) to the starting point (S) on the surface 66 may be generally perpendicular to the valve axis ($A_V$) when the intake valve 34 is engaged with the surface 66 at the starting point (S). More specifically, the tangent line (L1) may define an angle of eighty-five to ninety-five degrees relative to the valve axis ($A_V$). Similarly, a line (L2) tangent to the ending point (E) on the surface 66 may be generally perpendicular to the valve axis ($A_V$) when the intake valve 34 is engaged with the surface 66 at the ending point (E). More specifically, the tangent line (L2) may define an angle of eighty-five to ninety-five degrees relative to the valve axis ($A_V$).

Tangent lines defined between the starting and ending points (S, E) during displacement of the rocker arm at corresponding points of engagement with the intake valve 34 may also be generally perpendicular to the valve axis ($A_V$). As a result, the tangent lines of the surface 66 at points of engagement with the intake valve 34 may be generally perpendicular to the valve axis ($A_V$) along a majority of the engagement with the intake valve 34, and more specifically during an entirety of engagement with the intake valve 34. This orientation of the surface 66 of the rocker arm 46 relative to the intake valve 34 may reduce wear in the intake valve 34 at the engagement region with the rocker arm 46.

By way of non-limiting example, the surface 66 between the starting point (S) and the ending point (E) of rocker arm 46 may be defined by the following parametric differential equations:

$$dy = \tan\theta dx; \text{ and} \tag{1}$$

$$dx = \frac{R_o^2 \tan\theta}{(x\cos\theta + y\sin\theta)\cos\theta} d\theta; \tag{2}$$

where θ is the angle of rotation of the rocker arm 46 along the rotational axis ($A_R$), $R_O$ is the distance from the center of rotation (rotational axis ($A_R$)) of the rocker arm 46 to the starting point (S) along line (L1) at θ=0, and x and y are solved for to define the surface 66. A reference frame (x-y axis) may be attached to the rocker arm 46 and rotated with the rocker arm 46 as it rotates. The (x,y) profile of the surface 66 of the rocker arm 46 may be obtained by numerical integration of the parametric differential equations (1), (2).

Referring back to FIGS. 2-5, the lift mechanism engagement region 56 may include a bore 68 receiving the pushrod 48. The pivot region 60 may include an annular cylindrical body 70 extending along the rotational axis ($A_R$) and rotationally supported on the engine structure 12. The rocker arm 46 may be formed as a monolithic member and the body portion 62 may couple the valve engagement region 52, the lift mechanism engagement region 56 and the pivot region 60 to one another.

The body portion 62 may extend longitudinally between the valve engagement region 52 and the lift mechanism engagement region 56. The body portion 62 may include first, second, third, fourth, fifth and sixth ribs 72, 74, 76, 78, 80, 82 and may define an aperture 84. The first and second ribs 72, 74 may be located on a second side 86 of the rocker arm 46 opposite the first side 64 and may extend longitudinally between the valve engagement region 52 and the lift mechanism engagement region 56, defining a recess 88 laterally therebetween that extends into an outer surface of the second side 86 toward the pivot region 60.

The first and second ribs 72, 74 may extend radially outward from the pivot region 60 generally perpendicular to the rotational axis ($A_R$). The first and second ribs 72, 74 may be longitudinally aligned with the pivot region 60 and spaced from one another along an axial extent of the cylindrical body 70. The spacing (L3) between the first and second ribs 72, 74 may be at least ten percent of an axial extent (L4) of the cylindrical body 70. The first rib 72 may be located axially between a first end 90 of the cylindrical body 70 and the second rib 74. The first rib 72 may be located inward from the first end 90 a distance (L5) corresponding to at least ten percent of the axial extent (L4) of the cylindrical body 70 and the second rib 74 may be located inward from a second end 92 of the cylindrical body 70 a distance (L6) corresponding to at least ten percent of the axial extent (L4). The first and second ribs 72, 74 may include first ends 94, 96, respectively, terminating at the lift mechanism engagement region 56 and second ends 98, 100, respectively, terminating at a location along the longitudinal extent of the pivot region 60.

The third, fourth, fifth and sixth ribs 76, 78, 80, 82 may be located on the first side 64 of the rocker arm 46 and may extend laterally outward and generally parallel to the rotational axis ($A_R$). The third and fourth ribs 76, 78 may extend longitudinally from the pivot region 60 to the valve engagement region 52. The fifth and sixth ribs 80, 82 may extend longitudinally from the pivot region 60 to the lift mechanism engagement region 56.

The aperture 84 may extend laterally through the body portion 62 at a location between the pivot region 60 to the valve engagement region 52. The aperture 84 may define a cross-sectional area perpendicular to the rotational axis ($A_R$) that is at least twenty-five percent of a corresponding cross-sectional area of the body portion 62. The aperture 84 may be located longitudinally outward relative to the second ends 98, 100 of the first and second ribs 72, 74. The aperture 84 may extend from an outer surface of the cylindrical body 70 toward the valve engagement region 52 a distance (L7) corresponding to at least twenty-five percent, and more specifically at least forty percent, of the longitudinal (L8) distance between the outer surface of the cylindrical body 70 and the valve engagement region 52.

The geometry of the rocker arm 46 discussed above may reduce weight and rotational inertia of the rocker arm 46, as well as reduce wear on the valvetrain, while maintaining a structural integrity necessary to withstand loads applied on the rocker arm 46 during engine operation. It is understood that the present disclosure applies to use of the features discussed above individually as well as any combination thereof.

What is claimed is:

1. A rocker arm comprising:

a valve engagement region at a first longitudinal end of the rocker arm and on a first side of the rocker arm;

a lift mechanism engagement region at a second longitudinal end of the rocker arm opposite the first longitudinal end;

a pivot region located between the valve engagement region and the lift mechanism engagement region and defining a rotational axis for the rocker arm; and a body portion extending longitudinally between the valve engagement region, the pivot region and the lift mechanism engagement region and coupling the valve engagement region, the lift mechanism engagement region and the pivot region to one another, the body portion defining first and second ribs on a second side of the rocker arm opposite the first side, the first and second ribs extending longitudinally between the valve engagement region and the lift mechanism engagement region, the first and second ribs including a first rib end terminating at the lift mechanism engagement region and a second rib end terminating at a location along the longitudinal extent of the pivot region with the first and second ribs merging into a single wall extending from the second rib end to the valve engagement region and defining an aperture extending laterally through the wall at a location between the pivot region and the valve engagement region.

2. The rocker arm of claim 1, wherein the first and second ribs have an outward extent from the pivot region in a direction generally perpendicular to the rotational axis of the pivot region, defining a recess on the second side of the rocker arm extending into an outer surface of the second side and toward the pivot region.

3. The rocker arm of claim 2, wherein the first and second ribs are longitudinally aligned with the pivot region.

4. The rocker arm of claim 3, wherein the pivot region defines a cylindrical body extending along the rotational axis, the cylindrical body having first and second axial ends defining an axial extent of the pivot region, the first and second ribs being spaced from one another along the axial extent a first distance corresponding to at least 10% of the axial extent.

5. The rocker arm of claim 4, wherein the first rib is located between the first axial end of the cylindrical body and the second rib, the first rib being located inward from the first axial end a second distance corresponding to at least 10% of the axial extent and the second axial end being located at least the second distance inward from the second axial end.

6. The rocker arm of claim 1, wherein the aperture is located longitudinally outward relative to the second rib end of the first and second ribs.

7. The rocker arm of claim 1, wherein the pivot region defines a cylindrical body extending along the rotational axis, the aperture having a longitudinal extent from an outer surface of the cylindrical body toward the valve engagement region a distance corresponding to at least 25% of the longitudinal distance between the outer surface of the cylindrical body and the valve engagement region.

8. The rocker arm of claim 1, wherein the body portion includes third, fourth, fifth and sixth ribs extending laterally outward on the first side of the rocker arm and generally parallel to the rotational axis, the third and fourth ribs extending longitudinally from the pivot region to the lift mechanism engagement region and the fifth and sixth ribs extending longitudinally from the pivot region to the valve engagement region.

9. The rocker arm of claim 1, wherein the valve engagement region includes a non-constant radius of curvature adapted to define tangent lines at points of contact with a valve that are generally perpendicular to a longitudinal axis of the valve during displacement of the valve by the rocker arm.

10. The rocker arm of claim 1, wherein the rocker arm is an integrally formed monolithic member.

11. A rocker arm comprising:

a valve engagement region located at a first end of the rocker arm and including an engagement surface having a non-constant radius of curvature adapted to engage an engine valve and defining tangent lines at points of contact with the valve that are generally perpendicular to a longitudinal axis of the valve during displacement of the valve by the rocker arm;

a lift mechanism engagement region at a second end of the rocker arm opposite the first end;

a pivot region located between the valve engagement region and the lift mechanism engagement region and defining a rotational axis for the rocker arm; and a body portion extending longitudinally between the valve engagement region, the pivot region and the lift mechanism engagement region and coupling the valve engagement region, the lift mechanism engagement region and the pivot region to one another;

wherein the engagement surface includes a starting point for valve engagement during a valve opening event and an ending point for valve engagement during the valve opening event, the radius of curvature of the engagement surface continuously increasing from the starting point to the ending point.

12. The rocker arm of claim 11, wherein lines tangent to the engagement surface at points of engagement between the engagement surface and the valve at locations along the engagement surface between the starting and ending points are generally perpendicular to the longitudinal axis of the valve.

13. The rocker arm of claim 11, wherein a tangent line to the starting point when the starting point is engaged with the valve intersects the rotational axis and is generally perpendicular to the valve axis.

14. An engine assembly comprising:

an engine structure defining a combustion chamber and a port;

a valve supported by the engine structure and displaceable along a longitudinal valve axis from a closed position to an opened position to selectively provide communication between the port and the combustion chamber; and a rocker arm rotationally supported by the engine structure and including a valve engagement region located at a first end of the rocker arm having an engagement surface with a non-constant radius of curvature engaged with the valve and defining tangent lines at points of contact with the valve that are generally perpendicular to the longitudinal valve axis during displacement of the valve by the rocker arm;

wherein the engagement surface includes a starting point for valve engagement during valve opening and an ending point for valve engagement during valve opening, the radius of curvature of the engagement surface continuously increasing from the starting point to the ending point.

15. The engine assembly of claim 14, wherein lines tangent to the engagement surface at points of engagement between the engagement surface and the valve at locations along the engagement surface between the starting and ending points are generally perpendicular to the longitudinal axis of the valve.

16. The engine assembly of claim 14, wherein the rocker arm includes a pivot region defining a rotational axis for the rocker arm, a tangent line to the engagement surface at the starting point when the starting point is engaged with the valve intersects the rotational axis and is generally perpendicular to the valve axis.

* * * * *